US005273113A

United States Patent [19]

Schultz

[11] Patent Number: 5,273,113

[45] Date of Patent: Dec. 28, 1993

[54] CONTROLLING MULTIPLE TOOL POSITIONS WITH A SINGLE REPEATED REMOTE COMMAND SIGNAL

[75] Inventor: Roger L. Schultz, Richardson, Tex.

[73] Assignee: Halliburton Company, Duncan, Okla.

[21] Appl. No.: 992,400

[22] Filed: Dec. 18, 1992

[51] Int. Cl.[5] ..... E21B 34/08

[52] U.S. Cl. ..... 166/250; 166/65.1

[58] Field of Search ..... 166/65.1, 66, 66.4, 166/250, 374

[56] References Cited

U.S. PATENT DOCUMENTS

| | | | |
|---|---|---|---|
| 4,636,934 | 1/1987 | Schwendemann et al. | 364/132 |
| 4,856,595 | 8/1989 | Upchurch | 166/374 |
| 4,896,722 | 1/1990 | Upchurch | 166/250 |
| 5,189,415 | 2/1993 | Shimada et al. | 166/250 X |

*Primary Examiner*—Thuy M. Bui

*Attorney, Agent, or Firm*—Tracy W. Druce; Lucian Wayne Beavers

[57] ABSTRACT

A system is provided for remotely controlling a downhole tool in a well. A plurality of substantially identical command signals are transmitted into the well. Each of the command signals is received at the downhole tool by a controller having information stored therein identifying an operative command signal signature associated with that tool. Upon comparing each command signal to the stored information and confirming that the command signal contains the operative command signal signature associated with that tool, a control signal is generated by the controller for each confirmed command signal. An operating element of the downhole tool is advanced one position in a repeating series of operational positions in response to each successive control signal generated by the controller.

12 Claims, 13 Drawing Sheets

CONTROLLING MULTIPLE TOOL POSITIONS WITH A SINGLE REPEATED REMOTE COMMAND SIGNAL

BACKGROUND OF THE INVENTION

1. Field Of The Invention

The present invention relates generally to remote control of downhole tools, and more particularly but not by way of limitation to signaling techniques for communicating with a downhole tool.

2. Description Of The Prior Art

Traditionally, downhole tools such as those utilized in drill stem testing of oil and gas wells have been controlled either by physical manipulation of the pipe string which carries the tools or by changing the pressure applied to a column of fluid standing in the well, with that pressure being directly mechanically applied to a power piston of the tool so as to move an operating element of the tool. This second mode of operation includes those tools which are directly operated by changing well annulus pressure which is communicated with a power piston of the tools, or so-called annulus pressure responsive tools.

More recently, the development of downhole tools including programmed electronic controllers has made possible the use of remote controlled tools which may receive command signals transmitted from a remote command station, located at the earth's surface, through any one of several means to a receiver contained in the tool. The programmed electronic controller then causes the operating element of the tool to be actuated through any one of several types of operating systems in response to the remotely received command signal.

The communication systems typically provided for remote control tools in the prior art have utilized distinctly different command signals to instruct the tool to carry out each desired operation. Thus, a tool that has two positions such as an open position and a closed position of a valve will utilize two distinct command signals, one to tell the tool to move to an open position and another to tell the tool to move to a closed position. The system is further complicated when a tool has more than two positions and thus a multitude of distinct command signals are required to communicate with the tool.

SUMMARY OF THE INVENTION

The present invention provides an improved system for communicating with a remotely controlled downhole tool which greatly simplifies the complexity of the unique identification signals which must be used for each tool.

By means of the present system, each remotely controlled downhole tool has one and only one unique command signal signature associated therewith at any given time.

Thus, all communications with a given downhole tool are comprised of transmitting a plurality of substantially identical command signals into the well.

When each command signal is received at the downhole tool to which it is directed, a controller having information stored therein identifying an operative command signal signature associated with that downhole tool receives the command signal and compares it to information stored in the controller, thus confirming that the command signal contains the operative command signal signature associated with that downhole tool. The controller then generates a control signal for each confirmed command signal, and advances an operating element of the downhole tool one position in a repeating series of operational positions in response to each successive control signal generated by the controller.

In those situations where the downhole tool includes only a first and a second position, the operating element is toggled between the first and second positions in response to each successive control signal generated by the controller.

Preferably, the downhole tool also includes means for transmitting back to the remote command station a position confirmation signal indicative of which of the operational positions is currently occupied by the operating element of the tool.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 16 further illustrates the preferred manner in which the remotely controlled downhole tool can be programmed to receive the distorted command signal and store it in memory with a permissible operating command signal envelope which is truly representative of the appearance of the command signal when received downhole.

DETAILED DESCRIPTION OF THE PREFERRED EMBODIMENTS

Figure 1:
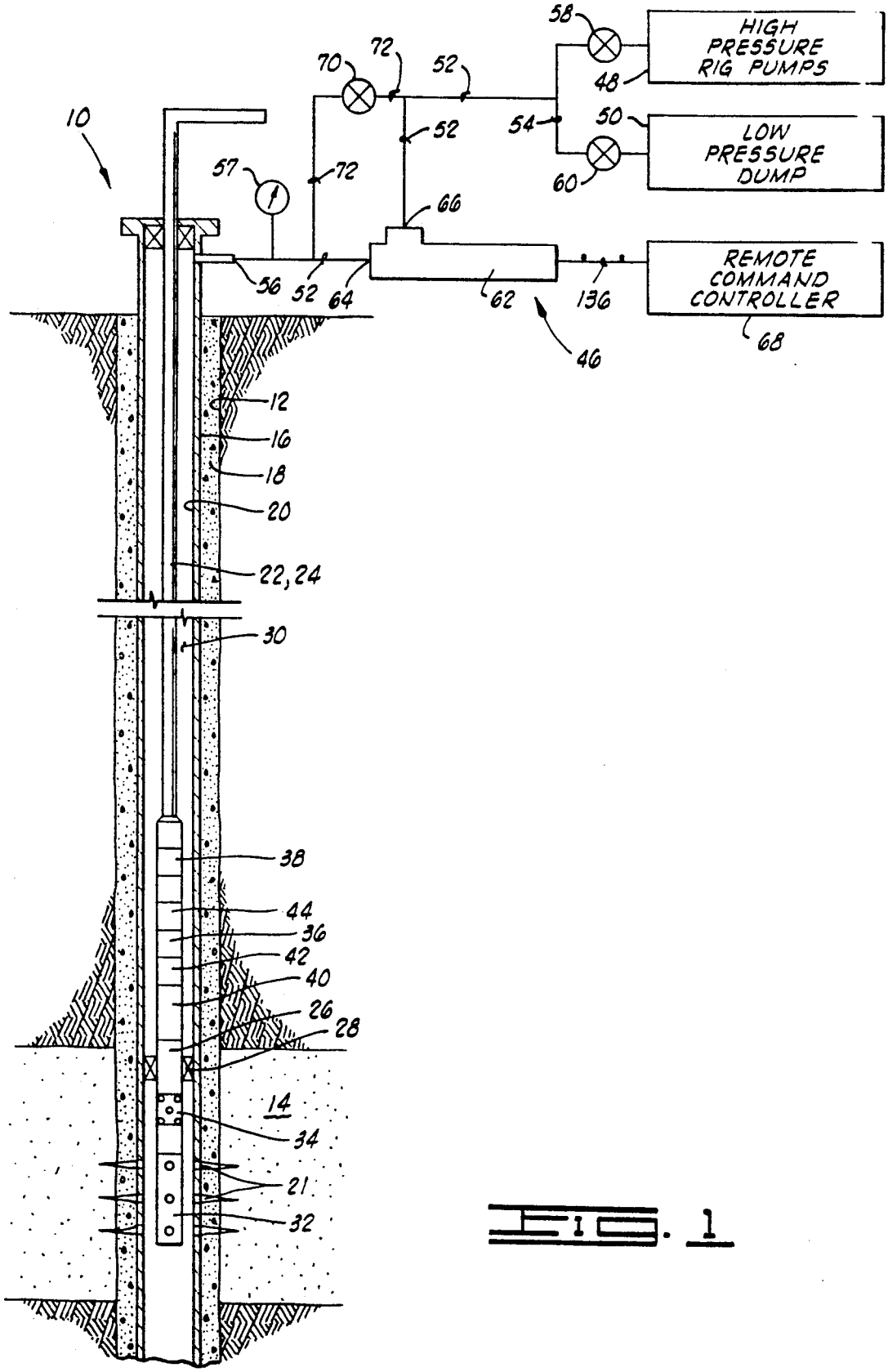
FIG. 1 is a schematic elevation sectioned view of a drill stem test string in place within a well, and of an annulus pressure control system for programmed automatic input of a pressure drop signal to the well annulus.

Turning now to FIG. 1, a schematic elevation view is thereshown of a typical oil or gas well 10. The well 10 is formed by a borehole 12 extending down through the earth and intersecting a subterranean formation 14. A well casing 16 is placed within the borehole 12 and cemented in place therein by cement 18. The casing 16 has a casing bore 20.

A plurality of perforations 21 extend through the casing 16 and cement 18 to communicate the casing bore 20 with the subsurface formation 14.

A drill stem test string generally designated by the numeral 22 is shown in place within the well 10. The drill stem test string includes a string of tubing 24 typically made up of a plurality of joints of threaded tubing. The tubing string 24 carries a plurality of tools on its lower end. A test packer 26 carries an expandable packing element 28 which seals between the test string 22 and the casing bore 20 to define a well annulus 30 therebetween.

The particular test string 22 shown in FIG. 1 carries a tubing conveyed perforating gun 32 which was utilized to create the perforations 21. A perforated sub 34 located above perforating gun 32 allows formation fluids from the subsurface formation 14 to enter the drill string 22 and flow upward therethrough under control of a tester valve 36. A reverse circulation valve 38 is typically located above the tester valve 36. An instrumentation package 40 is included to measure and record various downhole parameters of the well such as pressure and temperature during the testing operations. Other tools included in the drill stem test string 22 may include a sampler 42 and a safety valve 44.

Any of the tools contained in the drill stem test string 22 may be the subject of remote control operation, and particularly it is desirable to be able to operate the tester valve 36 and/or the reverse circulation valve 38 in response to remote command signals to control a program of draw-down and build-up testing during the drill stem test. The tester valve 36 will typically be opened and closed a plurality of times to perform a number of draw-down and build-up tests, and after that testing is completed, the circulation valve 38 will be opened to allow well fluids to be reverse circulated out of the tubing string 24.

In the upper portion of FIG. 1, a first embodiment is schematically illustrated of an annulus pressure control system for controlling annulus pressure in the well annulus 30 to send a remote control command signal to a downhole tool such as tester valve 36 or circulation valve 38. The annulus pressure control system is generally designated by the numeral 46. The particular annulus pressure control system 46 illustrated in FIG. 1 is designed solely to control pressure drop type command signals.

The well 10 has associated therewith a high pressure source 48 which typically is a plurality of high pressure rig pumps which are utilized to circulate drilling fluids down through the well. The well 10 also has associated therewith a low pressure dump zone 50 which typically is an open pit in which used drilling mud is received prior to being reconditioned and recirculated back into the well.

The annulus pressure control system 46 includes a conduit 52 which connects a rig pump manifold 54 to a well annulus inlet 56 so that the well annulus 30 can be communicated with either the high pressure source 48 or the low pressure dump zone 50 by opening valve 58 or valve 60, respectively, of the rig pump manifold 54. A pressure gauge 57 will typically be installed in conduit 52 adjacent the well annulus inlet 56.

The annulus pressure control system 46 includes a first control valve 62 having an inlet 64 and an outlet 66. The details of construction of the control valve 62 ar shown in FIG. 4 which is further described below.

The annulus pressure control system 46 also includes a remote command controller means 68, the details of which are further described below with regard to FIG. 11.

Annulus pressure control system 46 includes a bypass valve means 70 disposed in a bypass line 72 for bypassing fluid from the well annulus 30 past the control valve 62 to the low pressure dump zone 50.

Utilizing the annulus pressure control system 46 to transmit a pressure drop signal, the pressure in well annulus 30 will first be increased above hydrostatic pressure by closing valve 60 and opening valves 58 and 70 so that high pressure from the high pressure rig pumps 48 can be applied directly to the well annulus 30. The pressure of well annulus 30 can be visually observed with pressure gauge 57 until it reaches approximately the level desired. Then the valves 70 and 58 are closed, and the valve 60 is opened. Subsequent control of a drop in pressure in the well annulus 30 is provided by the control valve 62 under the control of the automated remote command controller 68.

THE CONTROL VALVE OF FIG. 4

Figure 4A:
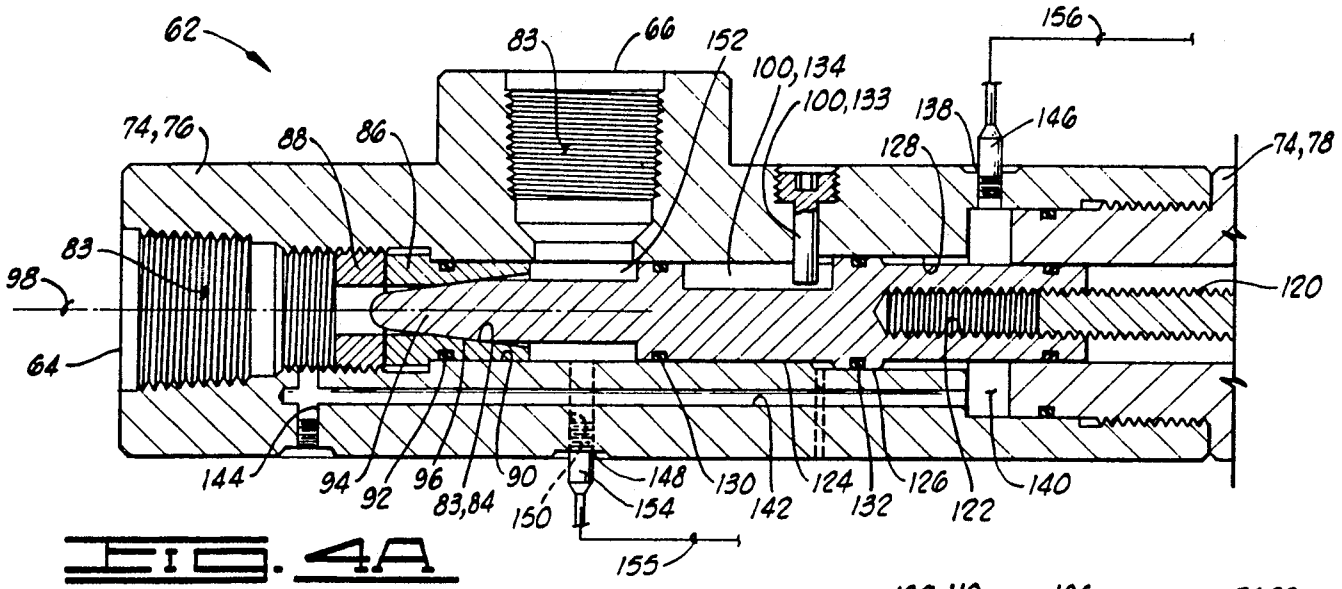
FIG. 4A and 4B show a cross-sectional view of the control valve utilized with the annulus pressure control systems of FIGS. 1–3.
Figure 4B:
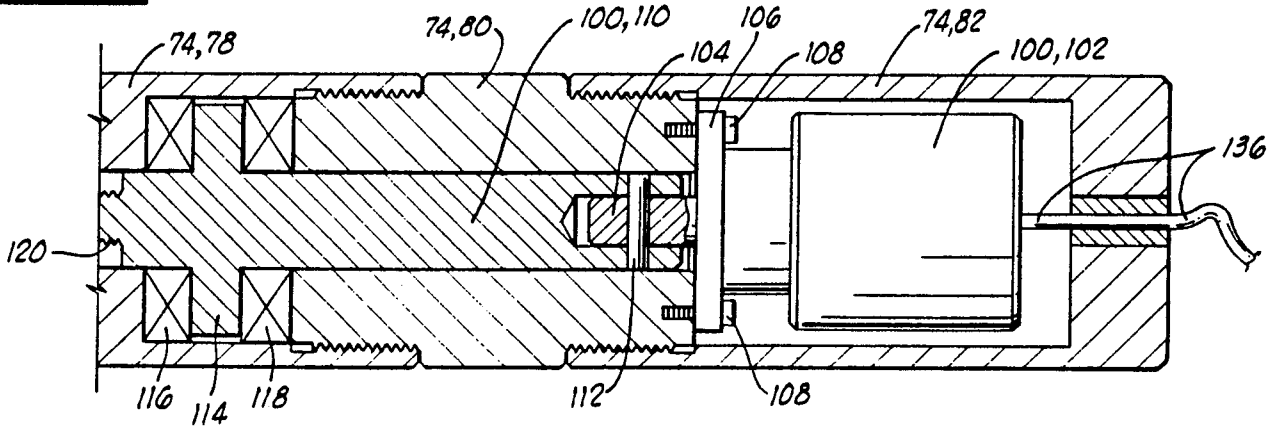

Turning now to FIG. 4, the details of construction of the control valve 62 are shown.

The control valve 62 includes a housing assembly 74 made up of a valve housing 76, a bearing housing 78, a housing adapter 80, and a motor housing 82.

The valve housing 76 has the inlet 64 and outlet 66 defined therein. Valve housing 76 has a flow passage 83 defined therethrough communicating the inlet 64 and outlet 66.

Control valve 62 includes a tapered valve seat 84 defined on a seat insert 86 which is received in the valve housing 76 and has a portion of the flow passage 83 defined therethrough.

The seat insert 86 is held in place by an annular externally threaded retainer 88 threadedly received in the flow passage 83. The seat insert 86 is closely received within a bore 90 of valve housing 76 with an 0-ring seal 92 therebetween.

The control valve 62 includes a tapered valve member 94 having an external conically tapered surface 96 which is complementary to the tapered seat 84. The valve member 94 is longitudinally movable within tapered valve seat 84 along a longitudinal axis 98 to define a variable area annular opening between the tapered valve seat 84 and the tapered outer surface 96 of valve member 94. The valve member 94 is shown in FIG. 4 in its closed position wherein it is closely engaged with the tapered seat 84 so that there is no flow through the flow passage 83. It will be appreciated that as the valve member 94 moves from left to right relative to the valve housing 76, an annular opening of ever-increasing area will be created between the tapered outer surface 96 and the tapered valve seat 84. This variable area annular opening provides a variable flow restriction to the flow of fluid through passage 83.

Control valve 62 includes a longitudinal positioning means 100 for moving the valve member 94 longitudinally relative to the valve seat 84 in response to the controller means 68.

The longitudinal positioning means 100 includes an electric stepper motor 102 having a rotatable motor shaft 104. A base 106 of stepper motor 102 is bolted to housing adapter 80 by a plurality of threaded bolts 108. Motor shaft 104 is connected to a lead screw shaft 110 by pin 112. Lead screw shaft 110 has a radially outward extending flange 114 defined thereon which is received between a pair of bearings 116 and 118. Lead screw shaft 110 carries on a forward portion thereof an externally threaded male lead screw 120.

Lead screw 120 is threadedly engaged with an internal threaded bore 122 of valve member 94.

Valve member 94 has two intermediate cylindrical outer surfaces 124 and 126 defined thereon which are closely received within bore 90 and counterbore 128 of valve housing 76 with sliding O-ring seals 130 and 132 being provided therebetween, respectively.

A radially inward extending pin 133 fixed to valve housing 76 is received in a longitudinal slot 134 cut in cylindrical outer surface 124 so that pin 133 and slot 134 provide a means for holding the valve member 94 rotationally fixed relative to valve housing 76 as the valve member 94 is longitudinally moved by the action of lead screw 120 engaging thread 122.

As is further described below, the electric stepper motor 102 receives power input from controller 68 through power supply conduit 136. Stepper motor 102 can be rotated in either direction in small increments thus incrementally moving valve member 94 relative to valve seat 84.

The valve housing 76 has an inlet pressure sensing port 138 defined therein which is communicated with the inlet 64 through an annular space 140 and eccentric longitudinal bore 142 and a radial bore 144. An inlet pressure sensor 146 is threadedly received in the inlet pressure sensing port 138.

Valve housing 76 also has an outlet pressure sensing port 148 defined therein which is communicated with the outlet 66 through radial bore 150 and annular space 152. An outlet pressure sensor 154 is threadedly received in outlet pressure sensing port 148.

The inlet pressure sensor 146 may be generally described as a pressure sensor means 146 for generating a pressure signal representative of the annulus pressure in well annulus 30 and transmitting that pressure signal along electrical conduit 156 to the remote command controller 68.

Figure 10:
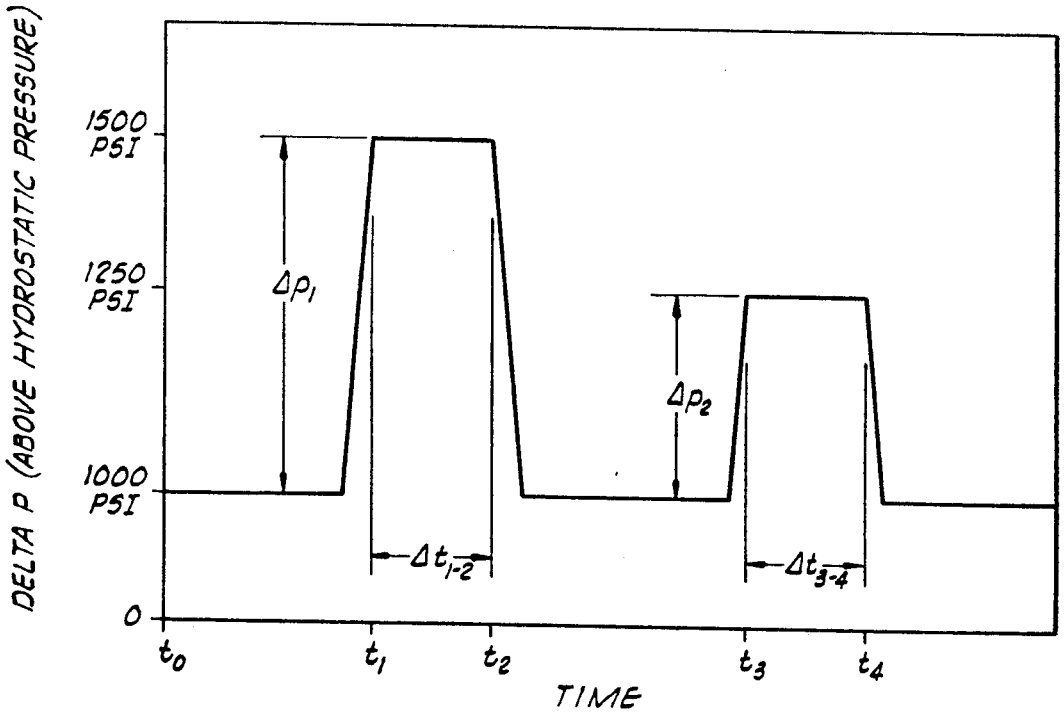
FIG. 10 is a graphic illustration of a high level pressure change signal format made up of two high level pressure pulses of differing magnitudes.
Figure 11:
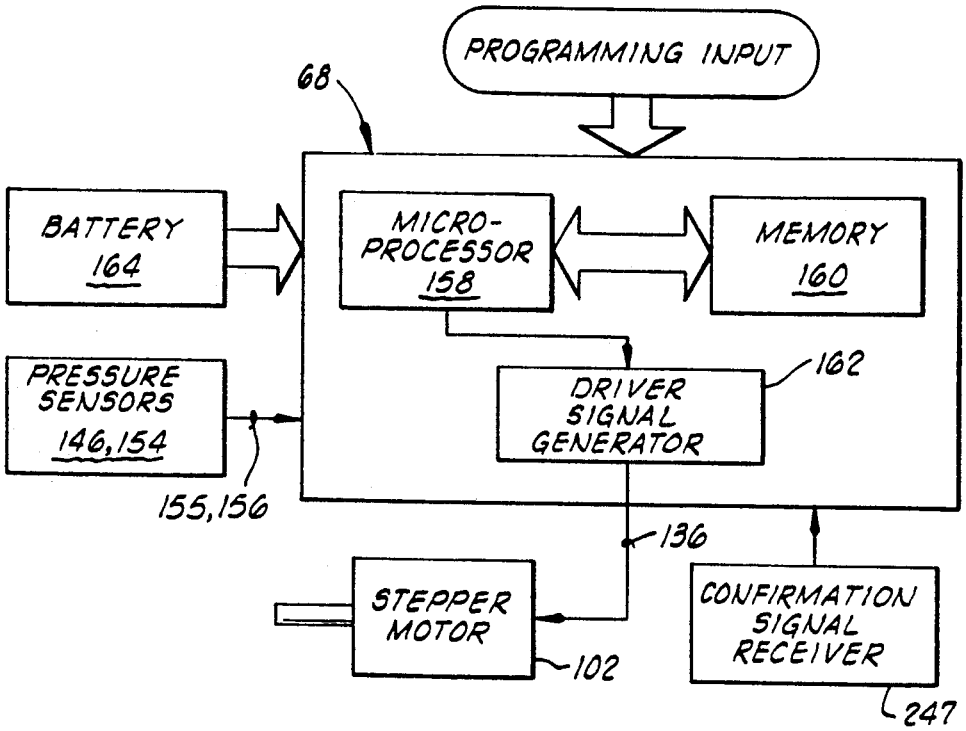
FIG. 11 is a schematic illustration of the automated microprocessor based controller of the annulus pressure control systems of FIGS. 1–3.

The controller means 68 is schematically illustrated in FIG. 11. The controller means 68 preferably is a microprocessor based controller including microprocessor 158 having a memory 160. The controller 68 can be programmed and information can be stored therein describing a desired command signal which is to be applied to the well annulus 30. The desired command signal will in all instances include at least one annulus pressure change. As is further described below with regard to FIGS. 5–10, there are many different types of annulus pressure change which may be programmed into controller 68. The controller 68 receives pressure signals from sensors 146 and 154 along electrical conduits 156 and 155.

The controller 68 includes a driver signal generator 162 under the control of microprocessor 158 for sending stepped electrical drive power signals to stepper motor 102 along conduit 136. Power for the controller 68 is provided by battery 164 or other suitable electrical power source.

As is further described below, the controller means 68 controls the position of valve member 94 through the rotation of stepper motor 102 in response to the pressure signals received from pressure sensors 146 and 154 and in response to the programmed information stored in memory 160, and thereby applies the desired annulus pressure change command signal to the well annulus 30.

THE EMBODIMENT OF FIG. 2

Figure 2:
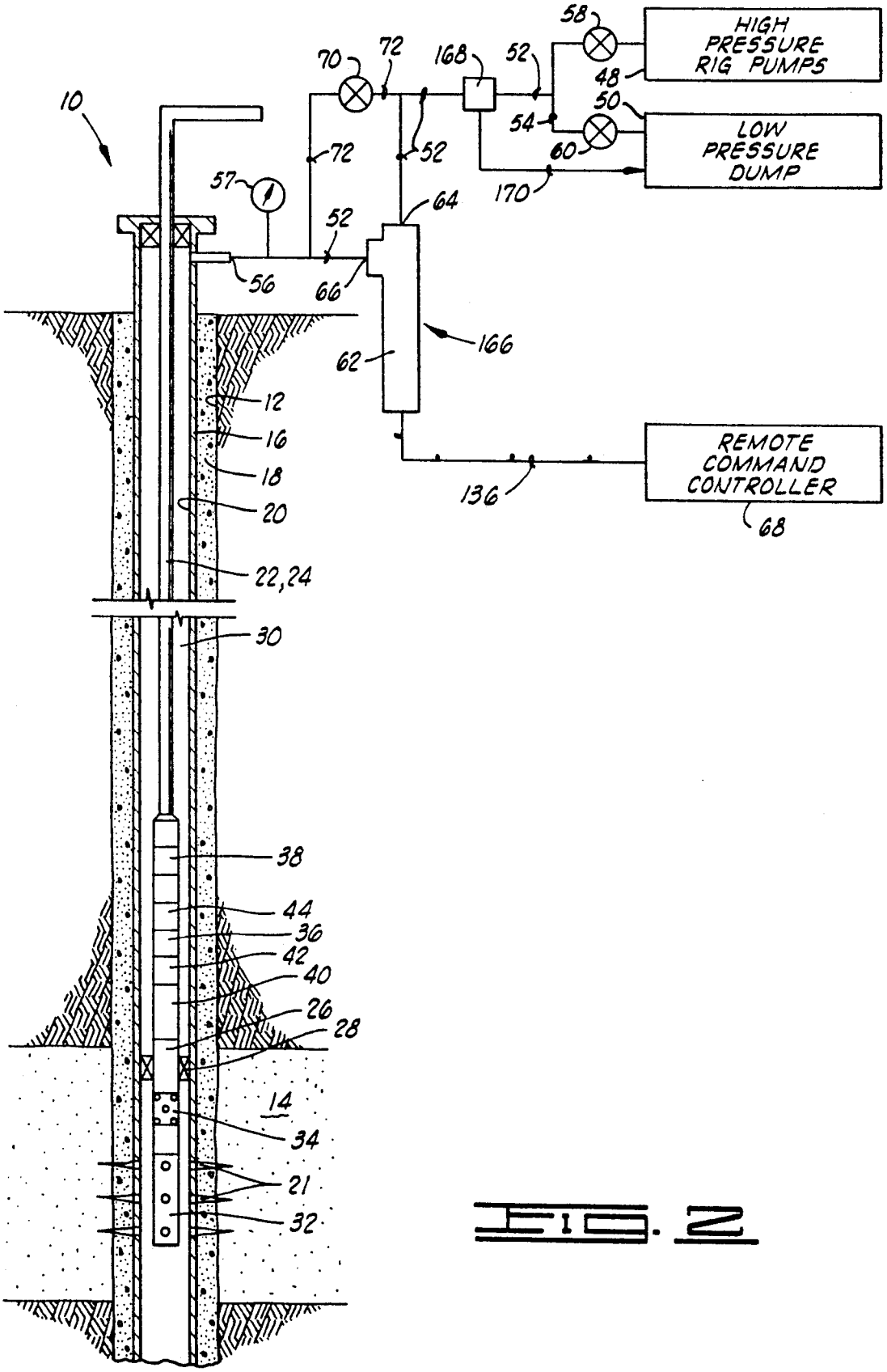
FIG. 2 is a view similar to FIG. 1 showing an alternative annulus pressure control system for automated control of a preprogrammed pressure rises command signal to be input to the well annulus.

FIG. 2 is a view similar to FIG. 1 showing a modified annulus pressure control system which is generally designated by the numeral 166. The annulus pressure control system 166 of FIG. 2 is designed to apply pressure increase signals to the well annulus 30.

The orientation of control valve 62 has been revised so that its inlet 64 is now connected to the rig pump manifold 54 and thereby may be connected to the high pressure source 48. The outlet 66 is now connected to the inlet 56 to the well annulus 30.

A pressure relief valve means 168 is disposed in conduit 52 between the inlet 64 of control valve 62 and the high pressure source 48. The relief valve 168 can be set to determine a maximum supply pressure provided to inlet 64. If the pressure from high pressure source 48 exceeds the set value of relief valve means 168, the relief valve means 168 will allow excess fluid to flow through a relief conduit 170 back to the low pressure dump zone 50.

Thus, to apply a pressure increase signal to the well annulus 30, the valve 58 is opened and the valve 60 is closed so that the high pressure source 48 is communicated through the control valve 62 to the well annulus 30. Again, the maximum pressure supplied to inlet 64 of control valve 62 is controlled by the pressure relief valve means 168.

The remote command controller 68 is programmed to apply the desired pressure rise to the well annulus 30 through the control valve 62.

If it is desired to manually control the application of pressure to well annulus 30, the bypass valve 70 can be utilized to bypass the control valve 62 thus allowing high pressure fluid to flow directly from source 48 to the well annulus 30 through bypass valve 70.

THE EMBODIMENT OF FIG. 3

Figure 3:
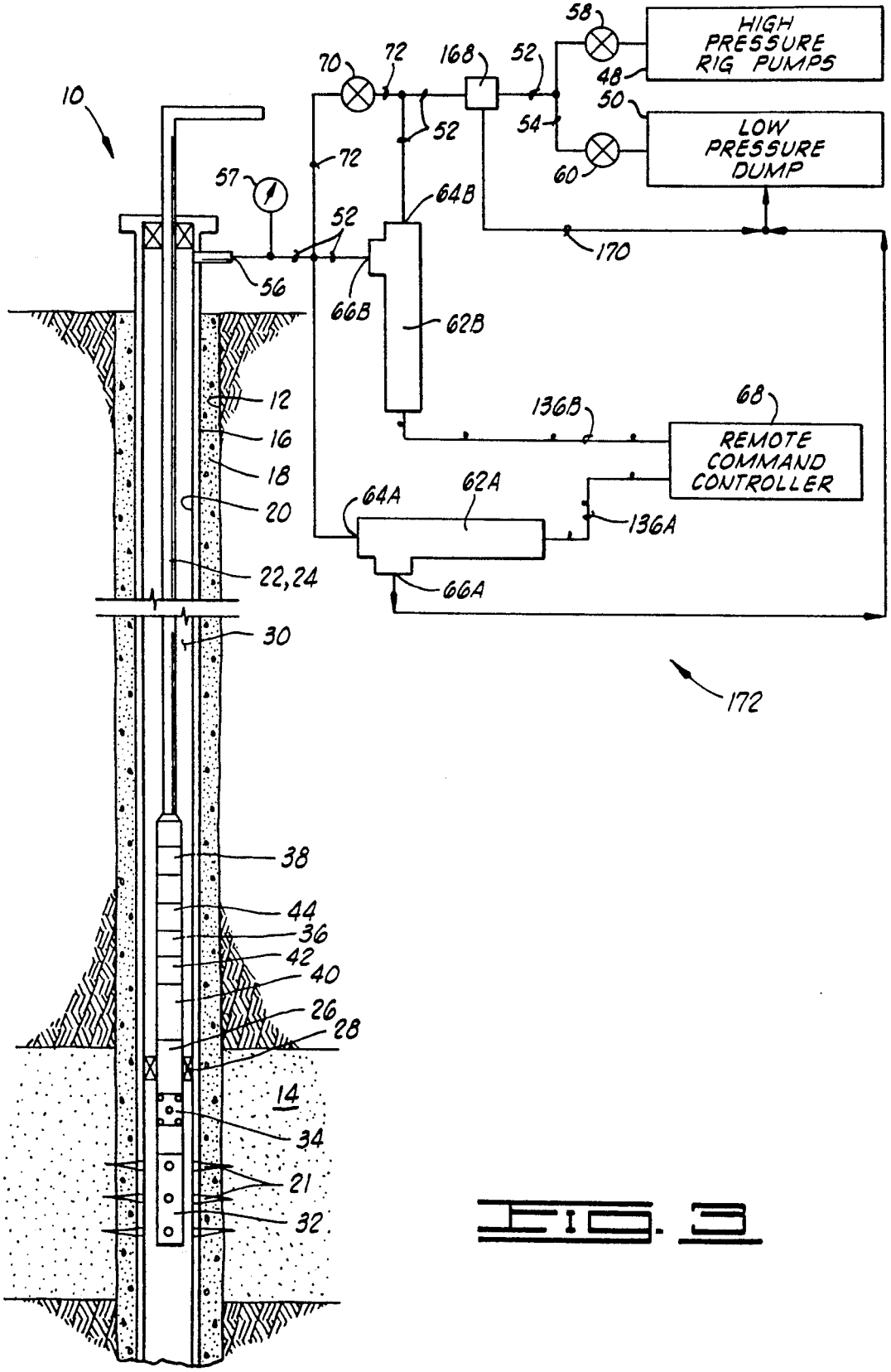
FIG. 3 is another view similar to FIG. 1 showing another alternative annulus pressure control system which is capable of automated input of preprogrammed pressure rise and/or pressure drop signals to the well annulus.

FIG. 3 is a view similar to FIGS. 1 and 2 which provides yet another embodiment of the annulus pressure control system which is generally designated by the numeral 172. The annulus pressure control system 172 of FIG. 3 can apply command signals to well annulus 30 which include both pressure drops and pressure rises. This is accomplished by using two control valves which are designated as 62A and 62B in FIG. 3. The inlet and outlet of control valve 62A are designated as 64A and 66A. The inlet and outlet of control valve 62B are designated as 64B and 66B. The control lines from remote command controller 68 to first and second control valves 62A and 62B are designated as 136A and 136B, respectively.

The first control valve 62A functions in the same manner as described above with regard to the control valve 62 of FIG. 1 to control dropping pressures in well annulus 30, and the second control valve 62B functions like the control valve 62 of FIG. 2 to control application of pressure rises to the well annulus 30.

Again the pressure relief valve means 168 is provided to control the maximum pressure supplied to inlet 64B of second control valve 62B from the high pressure source 48.

Also, the bypass valve 70 may still be utilized if it is desired to manually bypass the control valves 62A and 62B.

Although not illustrated in FIGS. 1-3, it will be appreciated that shut-off valves will typically be provided in the fluid conduit 52 near the inlets and outlets 64 and 66 of the control valve or valves 62 so as to allow the control valves 62 to be taken out of operation for repair, replacement or the like. These valves may also be utilized to manually block the flow to and from the control valves.

The use of any of the surface controllers of FIGS. 1-3 provides much more precise control of annulus pressure signals than do prior art systems. This allows for much shorter operating signal time windows.

THE HIGH PRESSURE CHANGE SIGNAL FORMATS OF FIGS. 5-10

FIGS. 5-10 are graphic illustrations of several different formats of pressure change command signals which may be input to the well annulus 30 under control of the remote command controller 68.

Each of the signals represented by FIGS. 5-10 can be generally described as including transmitting into the well a command signal including at least one high level pressure change applied to a column of fluid standing in the well, and particularly to the well annulus 30.

The term high level pressure change as used herein refers to a pressure change from a first value to a second value wherein the second value is at least about 1,000 psi above hydrostatic pressure of the column of fluid in the well to which the pressure change is applied, and wherein the pressure is maintained substantially at the second value for an interval of time corresponding to the information stored in the control system of the device such as valve 36 or 38 to which the command signal is directed. Thus, for pressure rises or pressure pulses, it is possible for the pressure to begin at hydrostatic pressure or at relatively low levels above hydrostatic pressure and then to be increased to a second value of at least about 1,000 psi, and thus a high level pressure change is provided. It is preferred, however, that both the first and second values of pressure defining the pressure change be sufficiently higher than hydrostatic pressure of the column of fluid in the well so that at the lower of the first and second values a majority of possible compression of the column of fluid has already occurred. The pressure above hydrostatic pressure at which the majority of compression of a given fluid will have occurred will of course vary for different well fluids and for different conditions of the well fluid. In general, however, if the lower value is at least about 1,000 psi above hydrostatic pressure, a majority of possible compression of the column of fluid will have occurred.

The importance of operating at pressures wherein the column of fluid is already substantially completely compressed to an incompressible state is that this eliminates the sponginess which is otherwise characteristic of a column of well fluid. If a pressure increase signal is applied to a column of well fluid which previously was at substantially hydrostatic pressure, a good deal of the energy input into the pressure signal will be damped due to compression of the well fluid, and thus the profile of the pressure change signal will be distorted as it moves downward through the well bore. If the signal is input into the well bore with pressures at all times being maintained substantially above hydrostatic pressure, however, the distortion of the signal due to compressibility of the fluid through which the signal must travel is greatly reduced.

Figure 5:
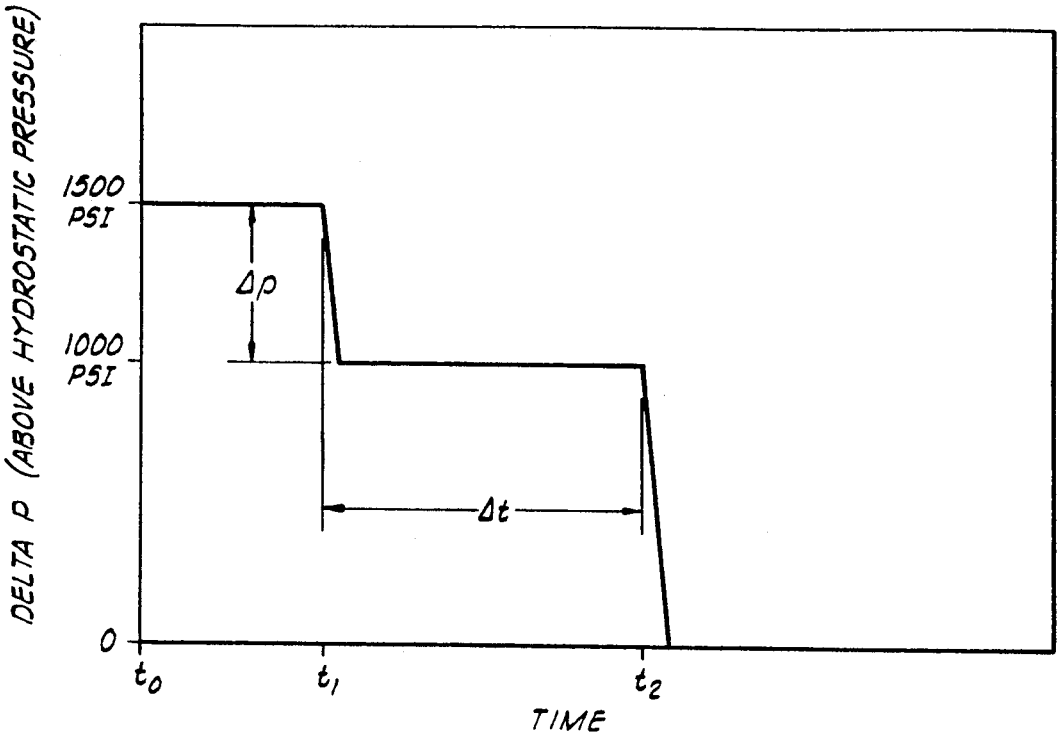
FIG. 5 is a graphic representation of a first possible high level pressure drop signal format.

FIG. 5 illustrates a command signal which includes a stepped pressure drop. As used herein, the term pressure drop refers to a pressure change from a higher first value to a lower second value.

Pressure drop signals may be preferable in many systems to pressure increase signals since even with the automated control systems like those shown in FIGS. 1-3, it is generally easier to precisely control the magnitude and timing of a pressure drop than it is to control the magnitude and timing of a pressure increase. This is due to the fact that the pressure drop can be achieved merely by throttling pressure from the well annulus to the low pressure dump zone 50 whereas a pressure rise depends upon the supply of high pressure fluid from high pressure source 48 which often will be somewhat erratic due to the pulsing of the high pressure rig pumps and related equipment.

The signal begins at time $t_0$ at a first value of 1,500 psi, and then at time $t_1$ the pressure drops to a second value of 1,000 psi. The pressure is maintained substantially at the second value of 1,000 psi for an interval of time $\Delta t$, and then at time $t_2$ the pressure is dropped to hydrostatic pressure.

For the signal represented in FIG. 5, the informational content of the signal includes the drop $\Delta p$ from the first pressure value of 1,500 psi to the second pressure value of 1,000 psi, and also includes the time interval over which the pressure is maintained at the second value, namely $\Delta t$.

Figure 6:
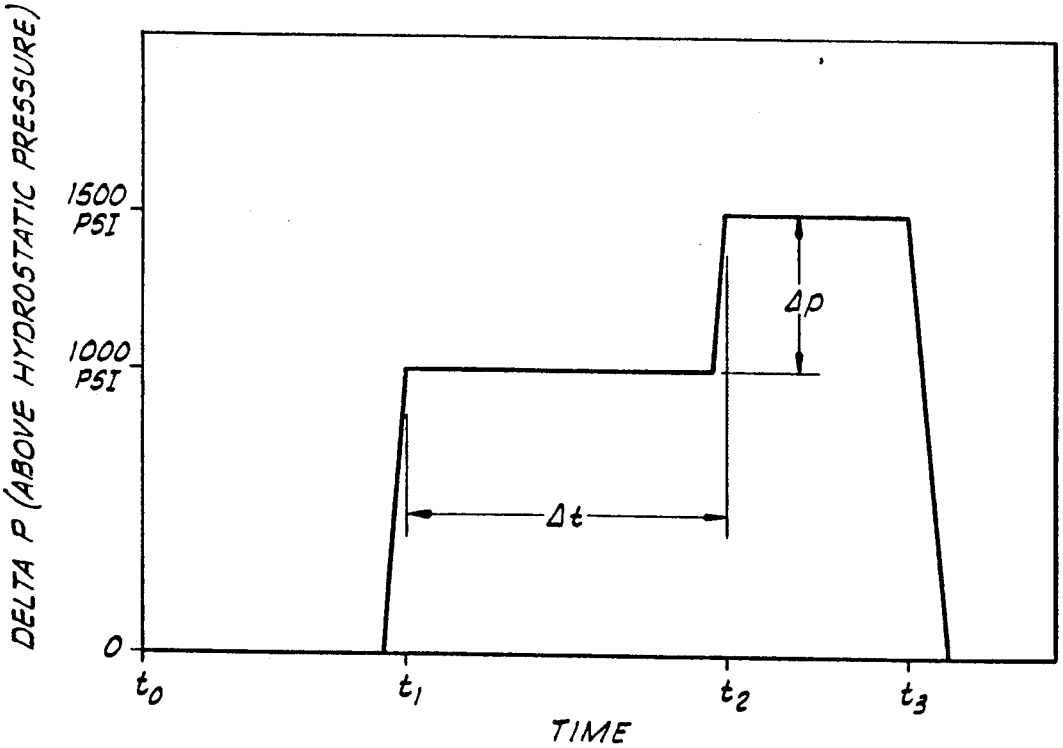
FIG. 6 is a graphic illustration of a high level stepped pressure rise signal format.

FIG. 6 illustrates another high level pressure change command signal format which includes a stepped pressure pulse. As used herein, the term "pulse" refers to a pressure change that begins at a first level, then rises to a higher level, and then drops back down to or toward the first level.

The signal represented in FIG. 6 begins at time $t_1$, prior to which the pressure in the well annulus has been at hydrostatic pressure. At about time $t_1$, a first pressure increase is applied to the well annulus 30 raising the pressure to approximately 1,000 psi. The pressure is maintained at approximately 1,000 psi for a time $\Delta t$ from $t_1$ to $t_2$. At time $t_2$, the pressure is further increased to a level of approximately 1,500 psi. Where it is maintained until approximately time $t_3$ at which time pressure is dropped back to hydrostatic pressure.

The informational content of the command signal represented in FIG. 6 will include the time $\Delta t$ over which the pressure is maintained at the level of 1,000 psi. It could also include the time interval from $t_2$ to $t_3$ over which pressure is maintained at the 1,500 psi level. Also, the informational content of the signal will include the pressure level at which the pressure is maintained, and could include the magnitude of the pressure change from 1000 psi to 1500 psi.

Figure 7:
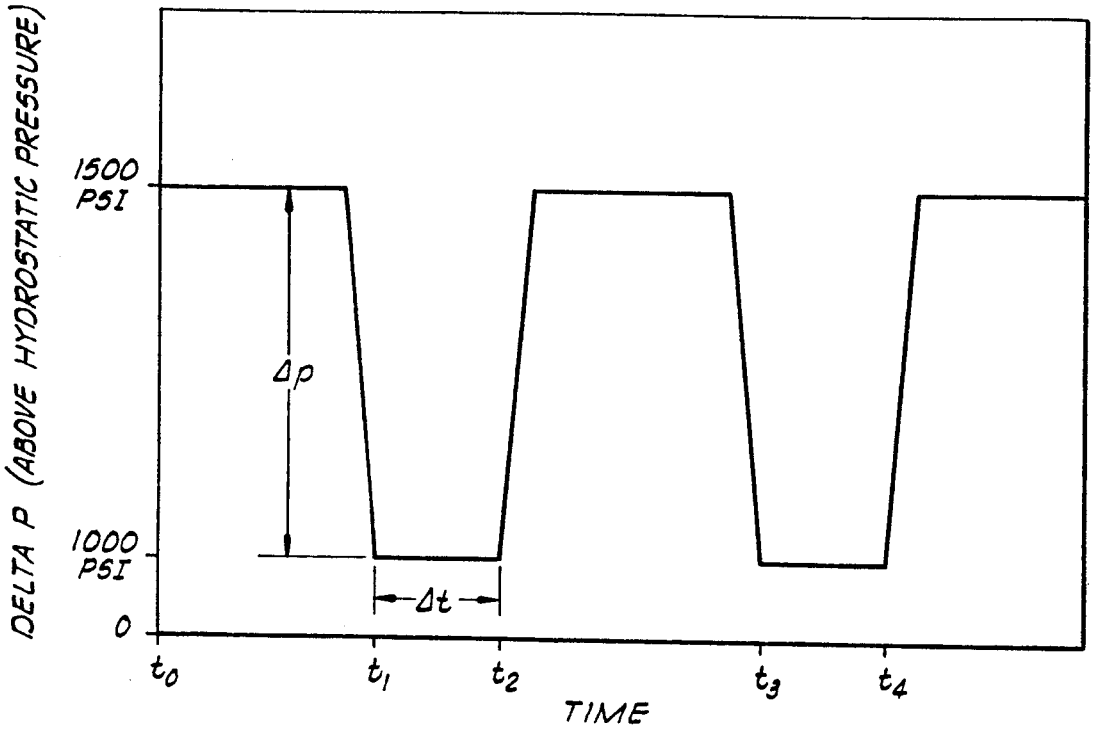
FIG. 7 is a graphic illustration of a high level pressure drop signal made up of two pressure dips.

FIG. 7 illustrates another format of pressure change command signal which includes two pressure dips. As used herein, the pressure dip refers to a pressure change beginning at a higher level, then dropping to a lower level, then returning back to another higher level which may or may not be the same as the initial higher level. Thus, a pressure dip includes a pressure drop followed by a pressure rise. A pressure dip may be a high level pressure dip in which case the lower pressure level will be at least about 1,000 psi above hydrostatic pressure in the well annulus. The pressure dip may, however, drop to levels below 1,000 psi above hydrostatic pressure.

For example, in FIG. 7, the pressure at $t_0$ is at a higher level of for example 1,500 psi. At about time t the pressure drops to a lower second level of approximately 1,000 psi at which it is maintained over a time interval $\Delta t$ until about time $t_2$. The pressure is then increased back to the initial level of approximately 1,500 psi. At approximately time $t_3$, the level is dropped back to the lower level of approximately 1,000 psi and maintained there until time $t_4$ at which time pressure is returned to approximately 1,500 psi.

The informational content of the first pressure dip preferably includes the magnitude of the pressure drop $\Delta p$ from 1,500 to 1,000 psi, and the time interval $\Delta t$ between $t_1$ and $t_2$ over which the second pressure level is maintained. The second pressure dip would have a similar informational content.

Figure 8:
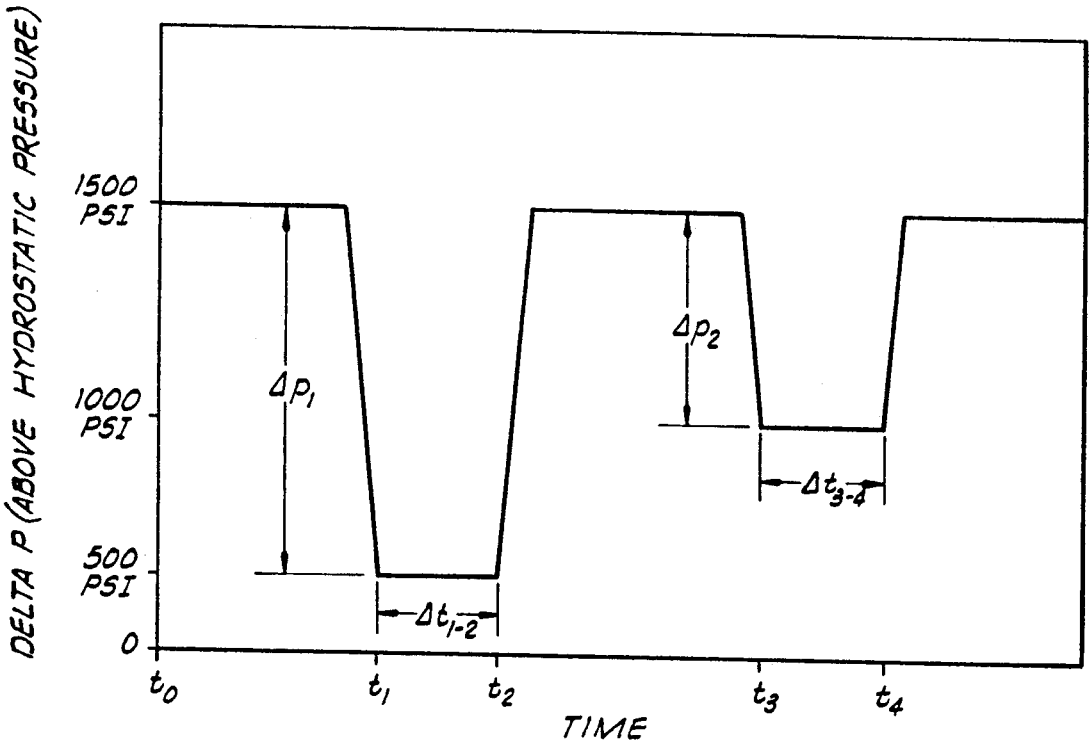
FIG. 8 is a graphic illustration of a high level pressure drop signal made up of two pressure dips of varying magnitudes.

FIG. 8 illustrates another double pressure dip command signal, this time with the first dip being of greater magnitude than the second dip. Signals like that of FIG. 8 may be preferred in some cases to a signal like that of FIG. 7 wherein both dips have the same magnitude. With a signal like that of FIG. 8 wherein the two dips are of differing magnitudes, various combinations of the larger and smaller pressure dips may be utilized to command different ones of the remote control tools located in the drill stem test string. If for example the larger first dip is A and the smaller second dip is B, then four different tools could be signaled with the various possible combinations of A and B with each signal including two dips. That is, the various signals which could be directed to the four tools would be AA, AB, BA and BB.

The command signal of FIG. 8 begins at time $t_0$ at a higher pressure level of approximately 1,500 psi. At about time $t_2$ it is dropped to a lower level of approximately 500 psi at which it is maintained until approximately time $t_2$. After time $t_2$, the pressure is raised back to approximately 1,500 psi. The second pressure dip occurs about time $t_3$ when pressure is dropped to an intermediate level of 1,000 psi at which it is maintained until time $t_4$ after which it is raised back to 1,500 psi.

The informational content of the first pressure dip preferably includes the magnitude of the first pressure drop $\Delta p_1$ from 1,500 to 500 psi, and the time interval $\Delta t_{1-2}$ from $t_1$ to $t_2$. Similarly, the informational content of the second pressure dip preferably includes the magnitude of pressure drop $\Delta p_2$ from 1,500 to 1,000 psi and the time interval $\Delta t_{3-4}$ from $t_3$ to $t_4$.

Figure 9:
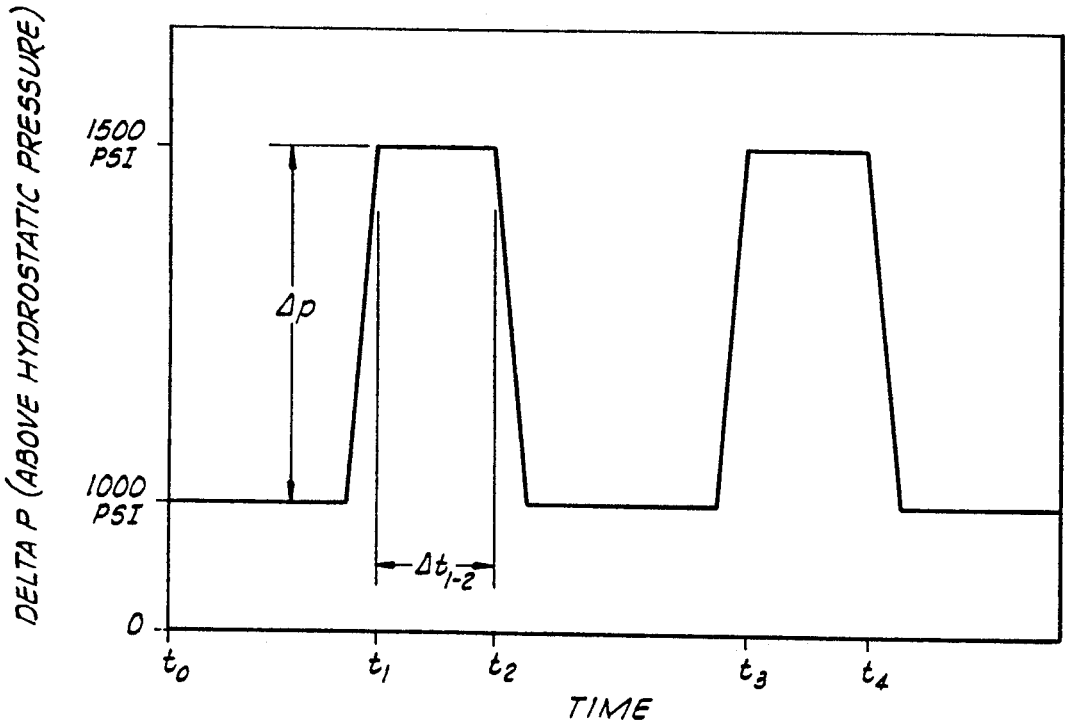
FIG. 9 is a graphic illustration of a high level pressure change signal format made up of two high level pressure pulses of equal magnitude.

FIG. 9 illustrates a command signal including two high level pressure pulses. The signal of FIG. 9 begins at time $t_0$ at a lower pressure level of approximately 1,000 psi above hydrostatic well annulus pressure, and at approximately time $t_1$ the pressure is raised to a higher level of approximately 1,500 psi at which it is maintained until approximately time $t_2$ at which point it is dropped back to the lower level. The second pressure pulse occurs at approximately time $t_3$ at which time the pressure is again increased to approximately 1,500 psi where it is maintained until approximately time $t_4$ at which time it is dropped again to 1,000 psi.

The informational content of the first pressure pulse preferably includes the magnitude of pressure rise $\Delta p$ from 1,000 to 1,500 psi and the time interval $\Delta t_{1-2}$ over which the pressure is maintained at the higher level.

It will be appreciated that two pressure pulses could also be provided wherein the pressure initially is at approximately hydrostatic pressure and is then raised to approximately 1,500 psi where it is held between times $t_1$ and $t_2$ and then dropped back to approximately hydrostatic pressure.

FIG. 10 illustrates a pressure command signal similar to that of FIG. 9, except that the second pressure pulse peaks at an intermediate level of for example 1,250 psi. A command signal system utilizing two pulses of different magnitudes may be utilized to communicate with a plurality of downhole tools wherein various combinations of magnitudes of pressure pulses are used to signal different ones of the downhole tools.

PROGRAMMING OF THE REMOTE COMMAND CONTROLLER 68 TO INPUT A PRESSURE CHANGE SIGNAL TO THE WELL ANNULUS

Figure 12:
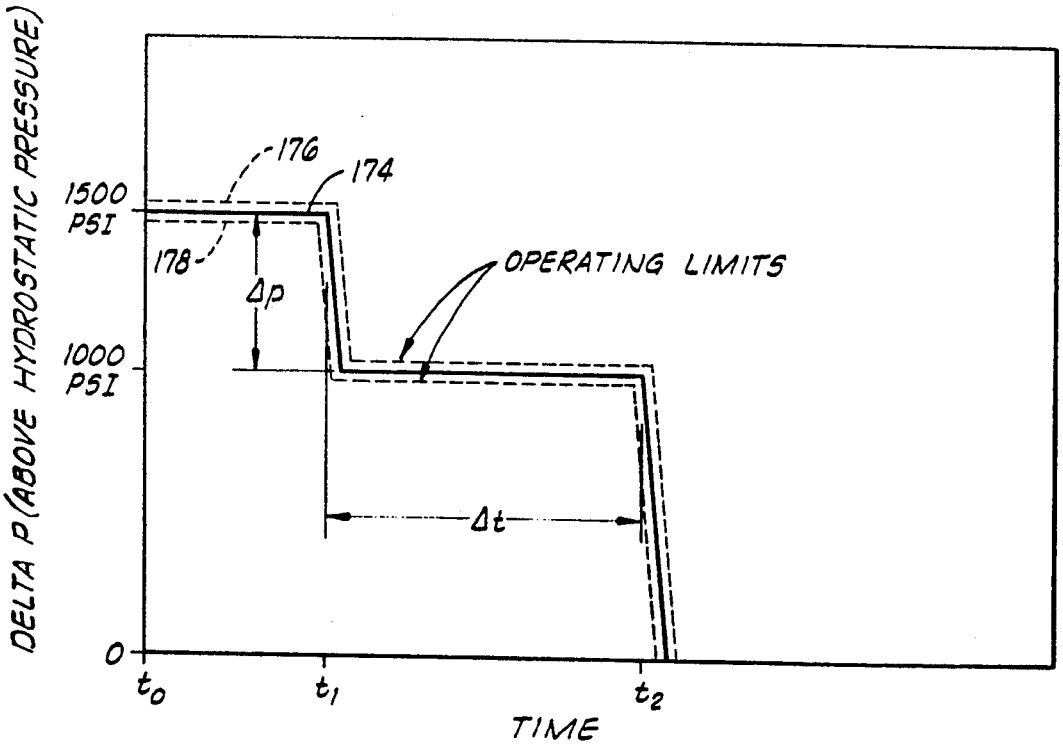
FIG. 12 is a graphic illustration of a high level stepped pressure drop input signal like that of FIG. 5 showing established operating limits as utilized by the microprocessor based controller of FIG. 11 to input such a high level stepped pressure drop signal into the well annulus.
Figure 13:
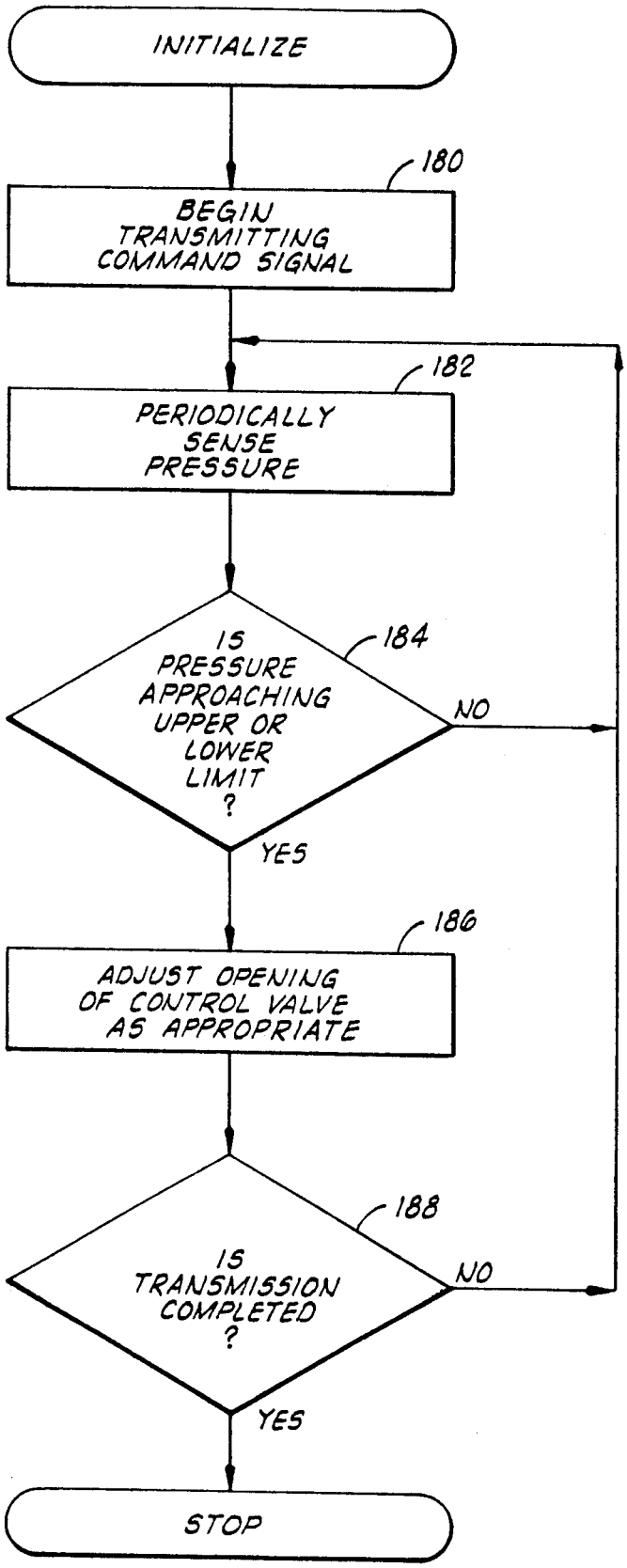
FIG. 13 is a logic flow chart for the programming of the microprocessor based controller of FIG. 11 to achieve the input signal of FIG. 12.

With reference now to FIGS. 12 and 13, the method by which the remote command controller 68 controls the control valve 62 to apply a desired pressure change command signal to the well annulus 30 will be described.

FIG. 12 represents a pressure change command signal having a stepped pressure drop like that previously described with regard to FIG. 5.

The programmed information stored in the microprocessor 158 and memory 160 includes a nominal value of the desired annulus pressure signal which is represented by the solid line 174 in FIG. 12. The stored information also includes upper and lower annulus pressure limits represented by dashed lines 176 and 178, respectively. The upper and lower limits 176 and 178 lie above and below the nominal value 174.

To apply the command signal represented in FIG. 12 to the well annulus 30 utilizing the control system of FIGS. 1 and the method is carried out generally as follows. The 11, valve 62 is provided between the well annulus 30 and the low pressure dump zone 50. The desired command signal represented in FIG. 12 is stored in the remote command controller 68 by storing information therein representative of the nominal value 174 and the upper and lower limits 176 and 178. The remote command controller 68 monitors pressure within the well annulus 30 by sensing that pressure with inlet pressure sensor 146. Controller 68 controls the position of tapered valve member 94 of control valve 62 in response to the stored information representative of the desired command signal and in response to the pressure sensed by inlet pressure sensor 146 so as to apply the command signal represented in FIG. 12 to the well annulus 30.

The manner in which this is accomplished by the microprocessor 158 of remote command controller 68 is generally represented in the logic flow chart of FIG. 13.

Prior to initiating the command signal the pressure in well annulus 30 will have been brought to the desired initial pressure of 1,500 psi by opening valves 58 and 70 and observing the pressure in well annulus 30 with pressure gauge 57. The remote command controller 68 will then control the position of control valve 62 so that the pressure in well annulus 30 is at the first pressure level of approximately 1,500 psi until time $t_1$, at which time the remote command controller 68 will throttle open the control valve 62 to drop the pressure to approximately 1,000 psi where it will be maintained until approximately time $t_2$ at which time it is dropped to hydrostatic pressure.

As shown in FIG. 13, by logic block 180, the microprocessor 158 causes the control valve 62 to begin transmitting the control signal of FIG. 12. Periodically the microprocessor 158 will sample the sensed pressure sensed by inlet pressure sensor 146 as indicated by block 182.

As indicated by block 184, if the sensed pressure is approaching either the upper or lower limit 176 or 178, the microprocessor 158 will cause the control valve 62 to either move toward a more open position or a more closed position, respectively, so as to bring the well annulus pressure back toward the nominal value 174. This adjustment is represented by block 186. This will continue until the transmission of the command signal is completed as determined by block 188 at which time the command signal will be terminated.

The information stored in the controller 68 defines a command signal signature including at least one pressure change of the column of fluid in well annulus 30. The information defines the nominal value 174 of the pressure of the column of fluid during the pressure change and defines the upper and lower limits 176 and 178 about the nominal value during the pressure change.

THE REMOTE CONTROL TOOL OF FIG. 14

Figure 14:
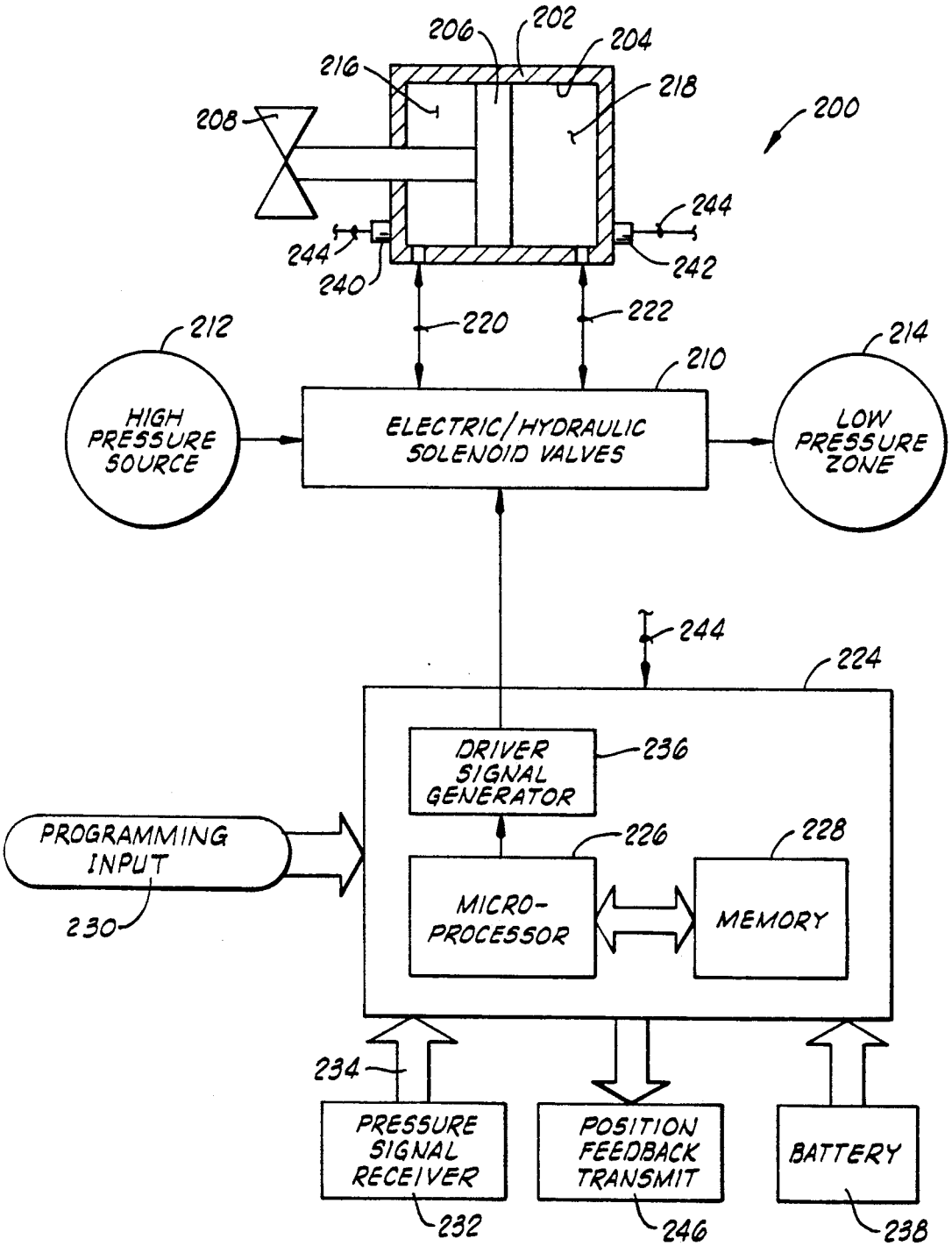
FIG. 14 is a schematic illustration of one of the remote controlled tools carried by the drill stem test string seen in FIGS. 1-3, and particularly includes a schematic representation of the microprocessor based controller and peripheral devices of the downhole remote control tool.

FIG. 14 is a schematic illustration of a representative one of the remote control tools carried by the drill stem test string 22. The tool shown in FIG. 14 is generally designated by the numeral 200 and it may for example represent the tester valve 36 or the circulation valve 38. It could also be any of the other tools of test string 22. For example, tool 200 could be a remote controlled firing head or a remote controlled gun release associated with perforating gun 32.

The valve 200 generally has a housing designated by the numeral 202. The housing 202 will be understood to contain all of the apparatus described with regard to FIG. 14

The housing 202 has a power chamber 204 defined therein within which is received a reciprocable power piston 206. An operating element 208 is operably associated with the power piston. Operating element 208 may for example be a ball-type tester valve such as shown in U.S. Pat. No. 3,856,085 to Holden et al. having an open position and a closed position. Operating element 208 may be a circulating valve such as shown in U.S. Pat. No. 4,113,012 to Evans et al. Also, the operating element 208 could be a multi-mode testing tool such as shown in U.S. Pat. No. 4,711,305 to Ringgenberg.

A bank of electrically operated hydraulic solenoid valves 210 control the communication of pressure from a high pressure source 212 and a low pressure zone 214 to first and second portions 216 and 218 of power chamber 204 through conduits 220 and 222.

The downhole tool 200 includes a programmable microprocessor-based control means 224. The control means 224 includes a microprocessor 226 and memory 228. Although a separate and distinct memory 228 is schematically represented in FIG. 14, it will be understood that the microprocessor 226 will itself contain some memory. References herein to storage and memory within the controller 224 may refer to storage within the separate memory 228 or within the microprocessor 226 itself.

Figure 15:
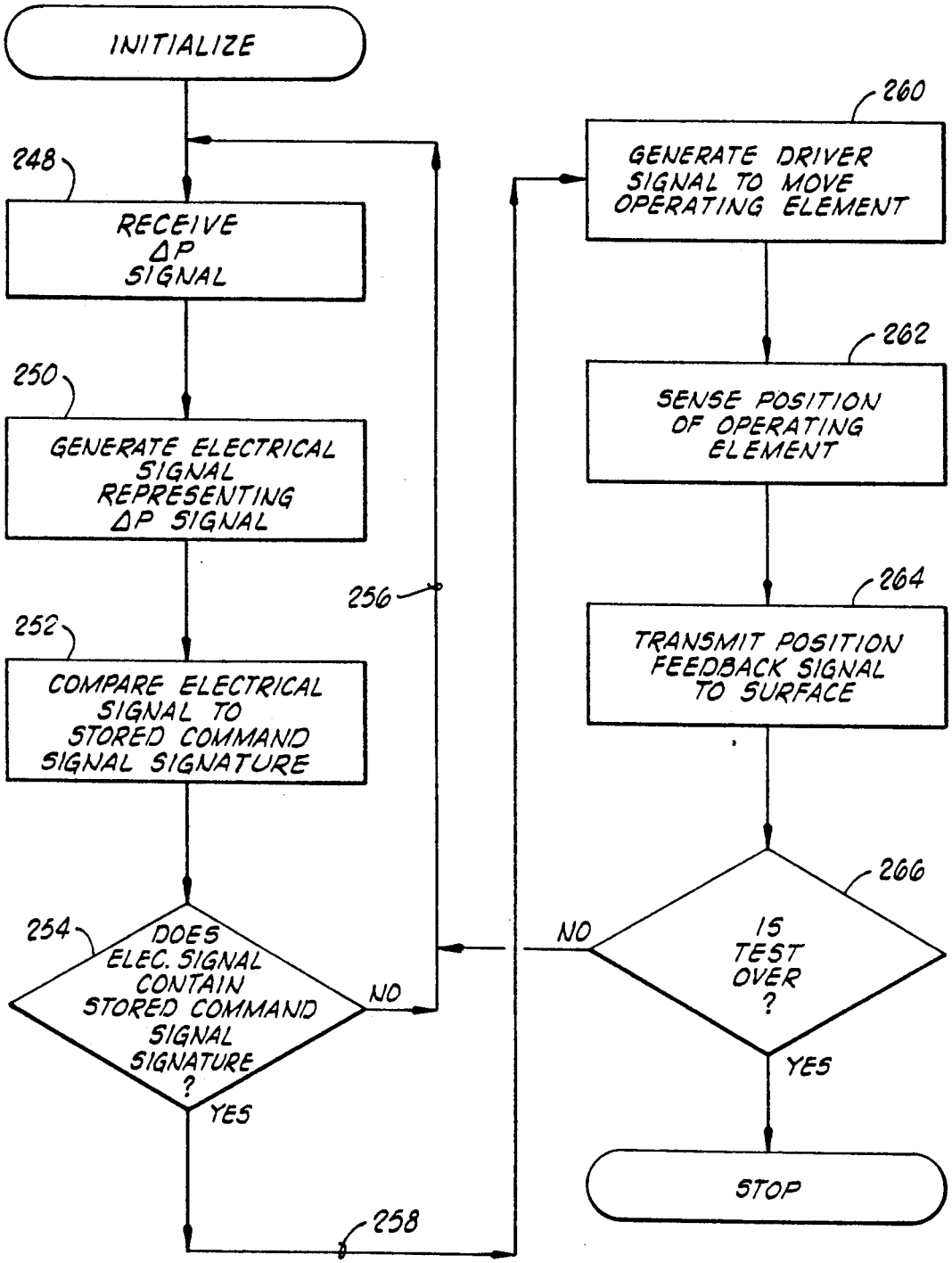
FIG. 15 is a programming logic flow chart representative of the manner in which the microprocessor based controller of FIG. 14 receives the command signals transmitted through the well annulus, verifies those signals and operates the downhole tool in response thereto.

Programming input 230 which is further described below with regard to FIG. 15 is placed within the microprocessor 226 and memory 228 to store information identifying the command signal to which the downhole tool 200 is to be responsive. The command signal may for example be one of those such as described above with regard to FIGS. 5-10.

A pressure transducer 232 receives pressure change signals in the well annulus 30 and converts pressure change signals to a changing electronic signal which is fed through appropriate data input interface 234 to the microprocessor-based controller 224. Receiver 232 may be described as a receiver means for receiving a command signal introduced into the column of fluid standing in well annulus 30 from a remote command station such as one of those described above with regard to FIGS. 1-3.

The microprocessor 226 compares the electrical signal received from pressure transducer 232 to the information stored therein identifying the desired command signal. The microprocessor 226 will when appropriate verify that the signal received by transducer 232 is the appropriate command signal directed to the downhole tool 200. The microprocessor 226 may be described as a comparing means 226 for comparing the electrical signal received from transducer 232 to the stored information and confirming that the command signal contains the operative command signal signature previously stored in the controller 224.

Upon verifying that the signal received is the command signal for which the tool 200 is programmed, the microprocessor 226 will direct a driver signal generator 236 to perform appropriate switching to direct electrical power from battery or power source 238 to the appropriate ones of the solenoid valves contained in the bank of electric/hydraulic solenoid valves 210 so that an appropriately directed pressure differential is applied across power piston 206 to move the operating element 208 to a desired position. The driver signal generator 236 may be described as a control signal generator means 236 for generating a control signal for each confirmed command signal. The electric solenoid control valves 210 and power piston 206 collectively may be referred to as an actuator means for moving the valve element 208 from one of its said open and closed positions to the other of its said open and closed positions in response to each control signal generated by the control signal generator means 236.

Preferably the high pressure source 212 will be the column of fluid standing in the well annulus 30, and when high level pressure change signals in the well annulus 30 are being utilized to communicate with the tool 200, the motive force for moving the valve element 208 is provided by applying pressure from the column of fluid in the well annulus 30 to the power piston 206 with that pressure being maintained substantially higher than the hydrostatic pressure of the column of fluid in the well annulus. For example, the hydrostatic pressure in the well annulus 30 may be maintained at 1,000 psi or more above hydrostatic pressure while operating the tool 200.

The downhole tool 200 is provided with first and second position sensors 240 and 242 to sense when the power piston 206 is in a position adjacent the respective ends of the power chamber 204, and for sending a signal through electrical conduit 244 to the controller 224. The controller 224 is programmed to generate position signals and to transmit signals representative of the position of operating element 208 up the well with transmitter 246. These signals may for example be received by confirmation signal receiver 247 of FIG. 11.

Any one of several known operating systems defining a high pressure source 212 and low pressure zone 214 may be utilized.

One system uses hydrostatic well annulus pressure as the high pressure source and an atmospheric air chamber defined in the tool as a low pressure zone. An example of such a system is seen in U.S. Pat. Nos. 4,896,722; 4,915,168; 4,796,699; and 4,856,595 to Upchurch.

Another approach is to provide both high and low pressure sources within the tool by providing a pressurized hydraulic fluid supply and an essentially atmospheric pressure dump chamber. Such an approach is seen in U.S. Pat. No. 4,375,239 to Barrington et al.

Still another system is to define two isolated zones within a well which have different pressures. For example, the well annulus may serve as a high pressure source and the tubing string bore may serve as a low pressure zone. Such a system is shown in U.S. Pat. No. 5,101,907 to Schultz et al.

REPEATED USE OF A SINGLE COMMAND SIGNAL TO TOGGLE A DOWNHOLE TOOL BETWEEN SUCCESSIVE POSITIONS

The controller 224 may be programmed to recognize any number of control signals associated with a given downhole tool 200 to cause the tool 200 to operate in the preferred manner. In a preferred embodiment of the invention, however, there is one and only one operative command signal signature associated with a given downhole tool 200. Thus, if it is desired to open, then close, then reopen the valve element 208, this is preferably accomplished by transmitting into the well a plurality of substantially identical command signals.

As each of those identical command signals is received in the downhole tool 200, the controller 224 identifies the command signal as including the previously programmed operative command signal signature associated with the downhole tool 200. The controller 224 then generates a control signal with driver signal generator 236 for each confirmed command signal. When each control signal is generated, the valve element 208 is advanced one position in a repeating series of operational positions.

If the valve element 208 is of the type which only has two operating positions, for example, an open position and a closed position, then this repeating series of operational positions will be comprised of an open position, a closed position, an open position, a closed position, etc. Other tools may have three or more operating positions and thus the repeating series of operational positions might for example be a first position, a second position, a third position, the first position, the second position, the third position, etc.

In the situation where the series of operational positions includes only a first position and a second position, such as the open and closed positions of valve element 208, the operating element or valve element 208 can be described as being toggled between first and second positions in response to each successive control signal generated by controller 224.

Particularly when using the preferred system having one and only one operative command signal signature associated with the downhole tool 200, the transmitter 246 will be utilized to transmit from the tool 200 a position confirmation signal indicative of which one of the operational positions is occupied by the valve element 208.

The system just described is considered preferable to a system utilizing two or more different operative command signals for directing the controller 224 to move the operating element 208 between its various positions, since the use of one and only one command signal considerably simplifies the programming of the controller 224.

FIG. 15 schematically illustrates a logic flow chart representative of the programming input 230 shown in FIG. 14 as being introduced into the controller 224 and certain peripheral steps related thereto.

A pressure change signal in the well annulus 30 is received at pressure transducer or pressure signal receiver 232 as represented by block 248. The transducer 232 generates an electrical signal representing the change in pressure signal as represented by block 250, which electrical signal is input to the controller 224 by interface 234.

The programming introduced at 230 to the controller 224 instructs the microprocessor 226 to compare the electrical signal received from transducer 232 to the stored command signal signature as indicated at block 252.

As indicated at block 254, the microprocessor 226 will determine whether the electrical signal received from transducer 232 contains the stored command signal signature. If it does not, the program will return as indicated at line 256 to that portion of the program wherein further signals will be monitored and processed.

If the microprocessor 226 determines that a received signal does contain the stored command signal signature, the program will advance along line 258 to block 260 wherein the microprocessor 226 will direct the driver signal generator 236 to generate a driver signal communicated to the solenoid valves 210 so as to cause the position of operating element 208 to be changed.

The position sensors 240 and 242 will sense the position of operating element as indicated by operational block 262 and that information will be fed through conduit 244 to controller 224 which will cause the position feedback transmitter 246 to transmit a position feedback signal to the surface as indicated at operational block 264.

As indicated at operational block 266, this process will be repeated until the test is over.

TEACHING A DOWNHOLE TOOL TO RECOGNIZE A DISTORTED OPERATING COMMAND SIGNAL

One of the biggest difficulties encountered when utilizing pressure signals transmitted through a column of fluid to control an intelligently programmed downhole tool is the fact that the pressure change signals will be distorted as they move through the column of fluid. Thus, a sharp pressure change input at the top of the well will not be so crisp when received at the pressure transducer 232 located in the downhole tool 200.

Figure 16:
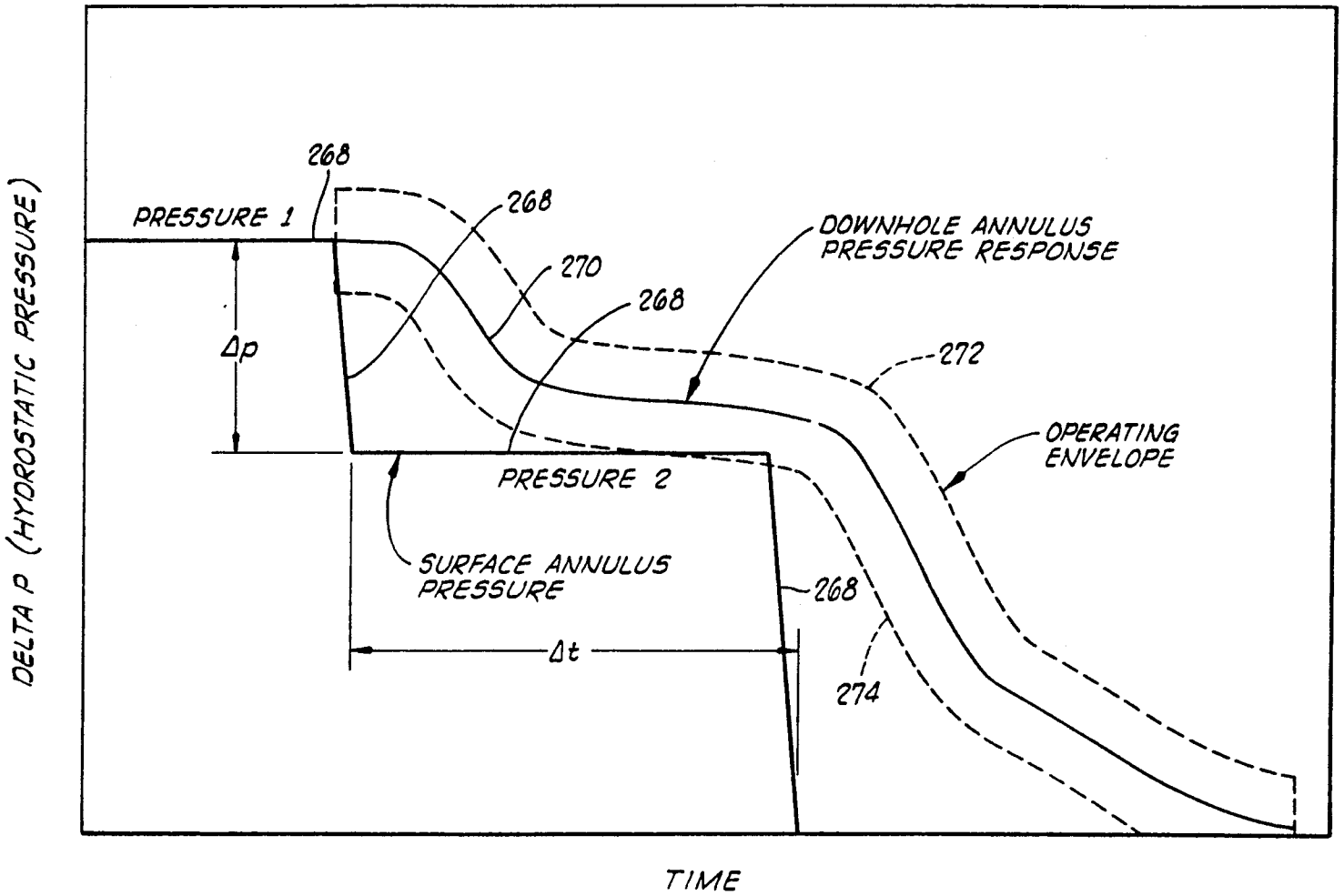
FIG. 16 is a graphic illustration of the manner in which a high level stepped pressure drop command signal like that of FIGS. 5 and 12 is distorted by the time it is received at the remote control downhole tool.

For example, FIG. 16 illustrates the manner in which a stepped pressure drop signal like that of FIG. 5 will be distorted by the time it reaches the downhole tool 200. In FIG. 16, the solid line 268 represents a stepped pressure drop signal as might be input at the top of the well as previously described with regard to FIG. 5.

The solid line 270, on the other hand, represents the pressure change over time that may actually be received at the transducer 232 located in the downhole tool 200. Thus, the pressure changes are not nearly so abrupt and they are spread over a longer time due to the distortion of the signal as it passes through the viscous fluid standing in the well annulus 30.

This presents a significant problem in that if the tool 200 is programmed to recognize the input signal 268, the signal may be so distorted when it reaches the downhole tool 200 that it will not be identified as having the command signal signature associated with the tool 200.

A preferred manner of overcoming this problem is to program the tool 200 after it has been placed in the well by teaching the tool 200 what the distorted form of the preferred command signal will look like when the distorted form of the command signal is received downhole.

This is accomplished by introducing into the well an original programming command signal which may for example appear like the solid line 268 in FIG. 16. As that original programming signal travels down through the well, it is distorted into a distorted programming command signal such as represented by the line 270.

The distorted programming command signal 270 is received by receiver 232 and is stored in the microprocessor 226 and/or memory 228 associated therewith.

This stored distorted programming command signal will then be utilized by the controller 224 to subsequently identify an operating command signal signature directed to the tool 200.

Preferably, once the distorted programming command signal has been received, a permissible operating command signal envelope is determined by controller 224 by setting upper and lower operating limits such as represented by the dashed lines 272 and 274 in FIG. 16.

The controller 224 may be programmed in several ways to receive the initial programming command signal. For example, the controller 224 may be programmed to first receive a specific wake-up signal which tells the controller 224 that the next signal to be received will be the distorted programming command signal which is to be stored along with the operating limits 272 and 274 for later use in identifying operating command signals. Also, the controller 224 may be preprogrammed to receive the distorted programming command signal during a specified time interval determined by a clock within the controller 224. As a third alternative, the controller 224 may be preprogrammed to receive updated distorted programming command signals during scheduled time intervals, again as determined by a clock contained within controller 224.

After the distorted programming command signal with its appropriate upper and lower limits has been stored within the controller 224, the downhole tool 200 is ready to receive operating command signals to cause it to move the operating element 208.

When it is desired to instruct the downhole tool 200 to move the operating element 208 between its various positions, an original operating command signal will be introduced into the well. The original operating command signal will have the same shape 268 when introduced into the well as did the previously introduced original programming command signal. As the original operating command signal travels down through the well, it will be distorted in a manner similar to that in which the original programming command signal was distorted so that when the operating command signal reaches the downhole tool 200, it will be a distorted operating command signal having a shape like that represented by line 270.

It will be understood that as conditions within the well change over time, there may be some variation in the amount of distortion of the signal. This is accommodated by setting appropriate upper and lower limits 272 and 274 defining the envelope about the acceptable distorted operating command signal.

The controller 224 will compare the distorted operating command signal to the distorted programming command signal (including upper and lower limits 272 and 274) previously stored in the controller 224 and will verify that the original operating command signal is in fact directed to the downhole tool 200.

Upon such verification, the controller 224 will cause the operating element 208 to be moved to a desired position.

Due to the fact that the conditions of the fluid in well annulus 30 will change over to time, it is desirable to periodically update the stored distorted programming command signal to compensate for changes in the well environment through which command signals must travel to reach the receiver 232. This can be done in several ways. As previously mentioned, the controller 224 may be preprogrammed to receive updated distorted programming command signals at scheduled intervals.

Also, in a preferred embodiment of the invention, the controller 224 is programmed to replace the stored distorted programming command signal including its upper and lower limits with a new stored signal each time a distorted operating command signal is verified as being directed to the tool. That is, each time an operating command signal is transmitted into the well and is received by receiver 232 and verified as being directed to the downhole tool 200 when it is compared to the previously stored programming command signal, the previously stored programming command signal will be replaced in the computer's memory with the most recently received and confirmed command signal.

When the test string 22 includes more than one remotely controlled tool, such as for example when tester valve 36 and circulating valve 38 are each to be remotely controlled, these steps can be repeated to assign a different, unique distorted programming command signal to each of the tools. Of course, each tool will have to have a unique wake-up signal or will have to be preprogrammed to receive its assigned distorted programming command signal at different times.

Figure 17:
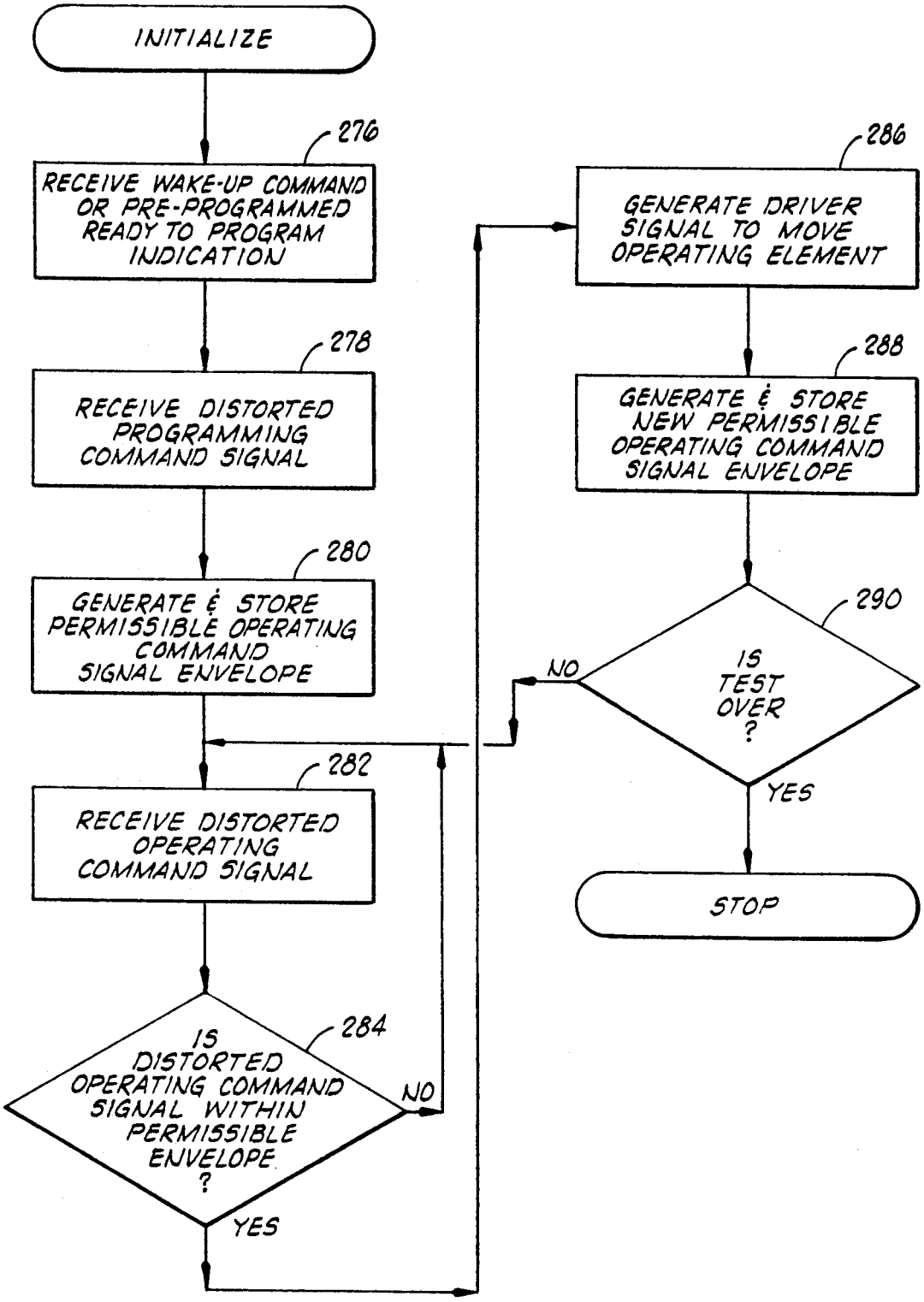
FIG. 17 is a programming logic chart representative of the manner in which the downhole microprocessor based controller of FIG. 14 receives and stores the distorted programming command signals like that of FIG. 16 having a permissible operating envelope representative of the distorted command signal as it is received at the downhole tool.

The programming input 230 which would be provided to controller 224 to allow downhole programming of the controller 224 to recognize distorted operating command signals is generally represented by the logic flow chart of FIG. 17.

As indicated in block 276, the tool 200 must first either receive a wake-up command or it must be preprogrammed so that at a certain time, the controller 224 will be ready to receive a distorted programming command signal.

As indicated at block 278, the controller 232 will receive the distorted programming command signal and will convert it into an electrical signal transmitted through interface 234 to the controller 224. The microprocessor 226 will generate and store a permissible operating command signal envelope such as that represented by upper and lower limits 272 and 274 in FIG. 16, and as represented by operational block 280 in FIG. 17. This envelope is established by offsetting the recorded points in a direction normal to the slope of the recorded pressure signal by a certain amount. Other schemes can be utilized to establish the operating envelope.

Operational block 282 represents the subsequent receipt of a distorted operating command signal when an operating command is input to the well.

As indicated at operational block 284, the microprocessor 226 will compare the distorted operating command signal with the previously stored permissible operating command signal envelope and determine whether or not the signal received is intended for the downhole tool 200. If the signal is not verified as being directed to the tool 200, the tool 200 will continue to monitor pressure with pressure signal receiver 232. If any part of the received signal falls outside the operating envelope, the tool will ignore the signal.

If a signal is received which is confirmed as being within the permissible operating command signal envelope, the controller 224 will cause driver signal generator 236 to generate a signal as represented by operational block 286 which will cause the operating element 208 to be moved.

The distorted operating command signal which was most recently verified by the controller 224 will then be used to generate and store a new permissible operating command signal envelope as indicated by operational block 288. Each signal the tool sees is recorded. If the signal is interpreted as a legitimate signal, this newly recorded signal is saved, and a new operating envelope is established around the most recent viable signal. This updating feature allows the tool to adjust its response envelope to meet changing conditions in the well. This helps compensate for changing well parameters such as mud viscosity, weight, or temperature.

As indicated by operational block 290, the controller 224 will continue to monitor for pressure signals until the testing is over.

This technique greatly increases the reliability of remote control of downhole tools. This method eliminates the guesswork involved in estimating the effects of the well system on a surface signal as it is received downhole. It also eliminates the need for surface signal compensation in an effort to produce a particular signal downhole.

Thus it is seen that the present invention readily achieves the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A method of remotely commanding a downhole tool in a well, said method comprising:

(a) transmitting into said well, from a remote command station, a plurality of substantially identical command signals;

(b) receiving each of said command signals at said downhole tool in a controller having information stored therein identifying an operative command signal signature associated with said downhole tool;

(c) comparing each of said command signals to said stored information in said controller and confirming that said command signal contains said operative command signal signature;

(d) generating a control signal with said controller for each confirmed command signal; and (e) advancing an operating element of said downhole tool one position in a repeating series of operational positions in response to each successive control signal generated by said controller.

2. The method of claim 1, wherein:

in step (e), said series of operational positions includes only a first position and a second position, and said operating element is toggled between said first and second positions in response to each successive control signal generated by said controller.

3. The method of claim 2, said downhole tool being a tester valve for controlling flow of well fluid through a tubing string, wherein:

in step (e), said first and second positions are open and closed positions of said tester valve.

4. The method of claim 1, further comprising:

(f) transmitting from said downhole tool back to said remote command station a position confirmation signal indicative of which one of said operational positions is occupied by said operating element.

5. The method of claim 1, wherein:

in step (a), each of said substantially identical command signals includes a pressure change applied to a column of fluid in said well.

6. The method of claim 5, wherein:

in step (a), said column of fluid is a well annulus of said well.

7. A remote controlled downhole tool apparatus, comprising:

an operating element having a plurality of operational positions;

a controller having information stored therein identifying one and only one operative command signal signature associated with said operating element, said controller including:

receiver means for receiving a command signal introduced into said well from a remote command station, and for generating an electrical signal representative of said command signal;

comparing means for comparing said electrical signal to said stored information and confirming that said command signal contains said operative command signal signature; and control signal generator means for generating a control signal for each confirmed command signal; and actuator means for advancing said operating element one position in a repeating series of said operational positions in response to each successive control signal generated by said control signal generator means.

8. The apparatus of claim 7, wherein:

said plurality of operational positions includes only a first position and a second position; and said actuator means is a means for toggling said operating element between said first and second positions in response to each successive control signal generated by said control signal generator means.

9. The apparatus of claim 8, said downhole tool apparatus being a flow tester valve for control of well fluid through a tubing string, wherein:

said operating element is a ball valve and said first and second positions are open and closed positions of said ball valve.

10. The apparatus of claim 7, further comprising:

feedback transmitter means for transmitting from said downhole tool apparatus back to said remote command station a position confirmation signal indicative of which one of said operational positions is occupied by said operating element.

11. The apparatus of claim 7, wherein:

said operative command signal signature requires that said command signal include at least one pressure change applied to a column of fluid in said well.

12. The apparatus of claim 11, wherein:

said column of fluid is a well annulus of said well.

* * * * *